US005481840A

United States Patent [19]

Dickson

[11] Patent Number: 5,481,840

[45] Date of Patent: Jan. 9, 1996

[54] LATERAL LOAD TRANSFER SYSTEM FOR OPERABLE WALLS

[75] Inventor: Wesley B. Dickson, Port Townsend, Wash.

[73] Assignee: Advanced Equipment Corporation, Fullerton, Calif.

[21] Appl. No.: 400,664

[22] Filed: Mar. 8, 1995

Related U.S. Application Data

[63] Continuation of Ser. No. 159,037, Nov. 29, 1993, abandoned.

[51] Int. Cl.[6] ..... E04B 2/56; E04B 2/58

[52] U.S. Cl. ..... 52/241; 52/243.1

[58] Field of Search ..... 52/243.1, 241, 52/238.1; 160/40

[56] References Cited

U.S. PATENT DOCUMENTS

| | | | |
|---|---|---|---|
| 268,836 | 12/1882 | Stearns . | |
| 831,904 | 9/1906 | Terrell et al. . | |
| 1,074,021 | 9/1913 | Smith . | |
| 2,893,071 | 10/1957 | Oden . | |
| 2,944,282 | 7/1960 | Greco . | |
| 3,253,552 | 5/1966 | Stein | 160/40 |
| 3,591,984 | 7/1971 | Lauterbach . | |
| 3,638,376 | 2/1972 | Howes et al. | 52/243.1 X |
| 3,701,179 | 10/1972 | Cox . | |
| 3,855,732 | 12/1974 | Sheaf . | |
| 4,277,920 | 7/1981 | Dixon | 52/241 X |
| 4,549,380 | 10/1985 | Haab | 52/243.1 X |
| 4,639,970 | 2/1987 | Adams . | |
| 5,063,636 | 11/1991 | Dickson . | |
| 5,159,793 | 11/1992 | Duego et al. | 52/243.1 X |
| 5,193,319 | 3/1993 | Classen et al. | 52/243.1 |

*Primary Examiner*—Carl D. Friedman
*Assistant Examiner*—Yvonne Horton-Richardson
*Attorney, Agent, or Firm*—Price, Gess & Ubell

[57] ABSTRACT

An operable wall panel is fitted at its top with retractable load transfer bolts and at its bottom with a floor engagement member. The load transfer bolts are normally biased to engage the panel guide track, while the floor engagement member provides an acoustic gasket having a serrated edge for engaging the mating edge of a floor-mounted insert. A lever and cable system provides one-step retraction of both the load transfer bolts and floor engagement member.

29 Claims, 4 Drawing Sheets

LATERAL LOAD TRANSFER SYSTEM FOR OPERABLE WALLS

This is a continuation of application Ser. No. 08/159,037, filed on Nov. 29, 1993 now abandoned.

BACKGROUND OF THE INVENTION

1. Field of the Invention

The subject invention relates to movable partitions, also known as operable walls and, more particularly, to an improved operable wall system providing improved response to lateral loads.

2. Description of Related Art

Operable walls, particularly those used to divide large spaces such as convention centers, ballrooms, and gymnasiums, may be subjected to lateral loading of the wall panels as a result of earthquake or pressure differential between the rooms divided by the operable walls. The wall panels in question can have dimensions of up to 5 feet wide and up to 40 feet high. Loads can reach on the order of 20 pounds per square foot (psf). Based on 5'×40' panel dimensions, and 20 psf, the load to be resisted at the top and at the bottom of the panel is 2,000 pounds.

Such significant lateral loading can occur, for example, between spaces divided by an operable wall in an exhibit area where one of the rooms is adjacent to an exterior wall containing large doors which may be opened during windstorms. The resultant pressure differentials may be large enough to cause suspension components to break and the walls to collapse. The ability of the operable wall panels to resist large lateral loads is limited by the relatively small-diameter, cylindrically-shaped trolley pendent bolts which suspend the operable wall panels from their overhead guide tracks.

Sliding of the bottom of the panels in response to lateral loads also constitutes a safety hazard for occupants of the space near the panels. The panels can move rather abruptly and without warning in response to such forces, enhancing the likelihood of injury or property damage. According to conventional panel design, resistance to sliding has been dependent upon friction between the flat floor surface and the bottom panel seal. This magnitude of resistance to sliding has proven insufficient in some cases.

Thus, there exists a need to substantially reduce the possibility of sliding of the panels. There also exists a need to impart significant additional strength to the ability of the top of the panels to resist large lateral loads.

OBJECTS AND SUMMARY OF THE INVENTION

It is therefore an object of the invention to improve operable wall systems;

It is another object of the invention to provide a method and apparatus for improving the resistance of operable wall systems to lateral loads;

It is another object of the invention to provide an operable wall system reinforced against lateral loads at the point where the operable wall panel interfaces with its overlying suspension system;

It is another object of the invention to provide an operable wall system which eliminates or reduces sliding of the bottoms of the operable panels in response to lateral loads; and It is yet another object of the invention to provide operable wall apparatus with improved resistance to lateral loads which is convenient to use and relatively cost-effective to manufacture.

According to one aspect of the invention, the lateral load capacity of the top of an operable wall panel is greatly increased by means of retractable top load transfer means, preferably biased in the "up" or extended position, and mechanically latched "down" when not in use so as to lie flush with the top edge of the wall panel. Such top load transfer means, when extended, interfit with the structural elements of the guide track so as to transfer lateral loads directly from the top of the operable wall panel to the guide track. The top load transfer means thus act independent of the normal cylindrical-shaped trolley bolts, relieving the trolley bolts of loads other than vertical.

According to another aspect of the invention, sliding of the bottom of operable wall panels is prevented by a floor engagement means, which transfers the lateral load at the bottom of a panel directly to the floor. Such a floor engagement means greatly increases the ability of the bottom of an operable wall panel to resist lateral sliding motion. In one embodiment, the floor engagement means includes a lower floor engagement member carrying an acoustic gasket, which may be lowered to engage a floor insert member fixed to the floor.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTIONOF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide easily operated and conveniently manufactured apparatus for improving the resistance of operable walls to lateral loads.

Figure 1:
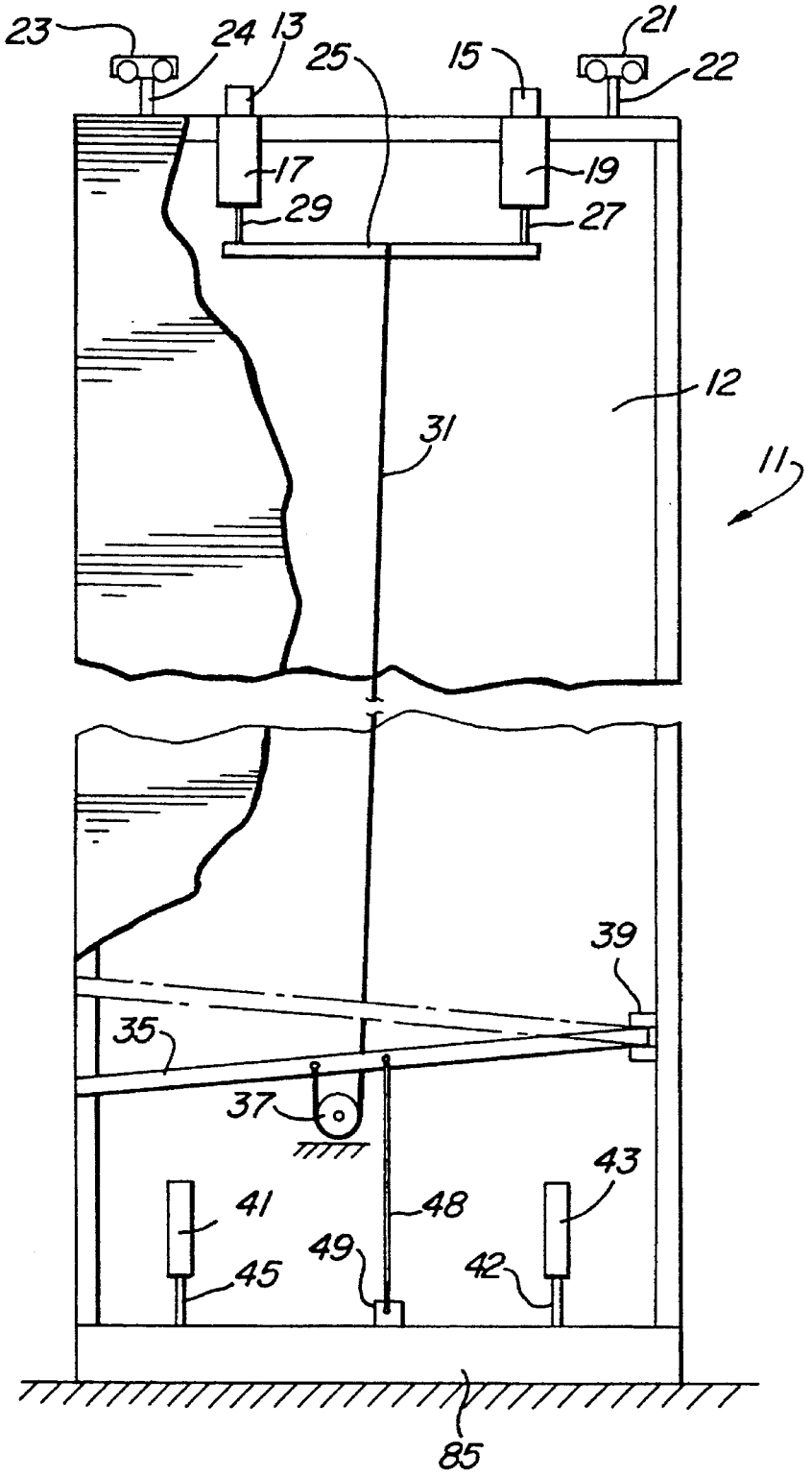
FIG. 1 is an elevation of an operable wall panel employing lateral load transfer apparatus according to the preferred embodiment.

An operable wall 11 according to the preferred embodiment is illustrated in FIG. 1. The wall 11 generally includes a wall panel 12 suspended from the ceiling by a guide track mechanism employing trolleys 21, 23 connected to the panel 12 by dependent bolts 22, 24. Apparatus according to the preferred embodiment for stabilizing the wall panel 12 against lateral loads includes upper top load transfer bolts 13, 15 and a lower floor engagement member 85. The lower floor engagement member is connected to first and second floor engagement pistons 42, 45. The load transfer bolts 13, 15 and lower floor engagement member 85 are actuated by an intervening mechanism including upper and lower actuation cables 31, 48 and a lever 35.

Figure 2:
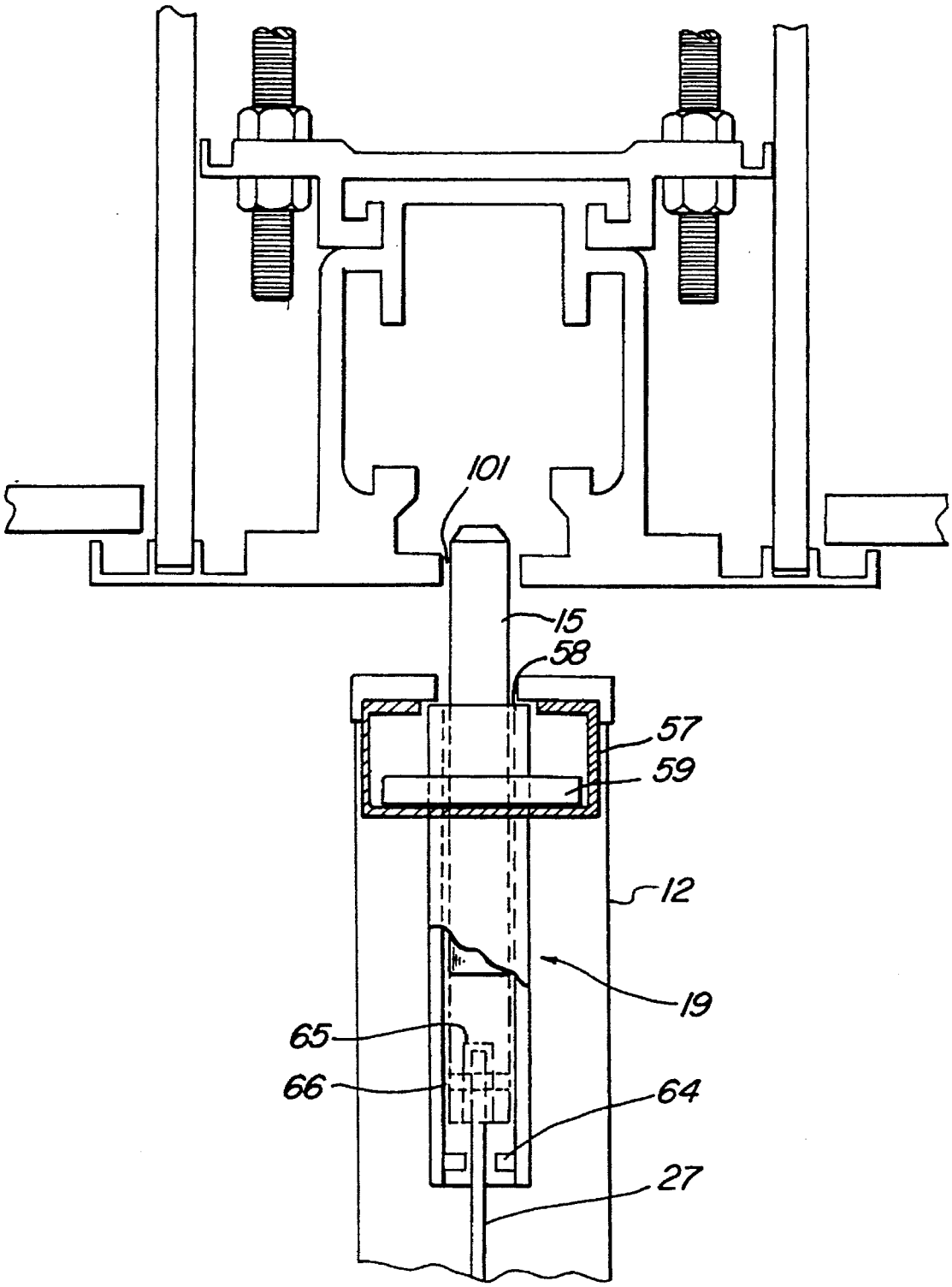
FIG. 2 is a cross-sectional drawing illustrating the interface between a load transfer bolt and an operable wall guide track according to the preferred embodiment.
Figure 3:
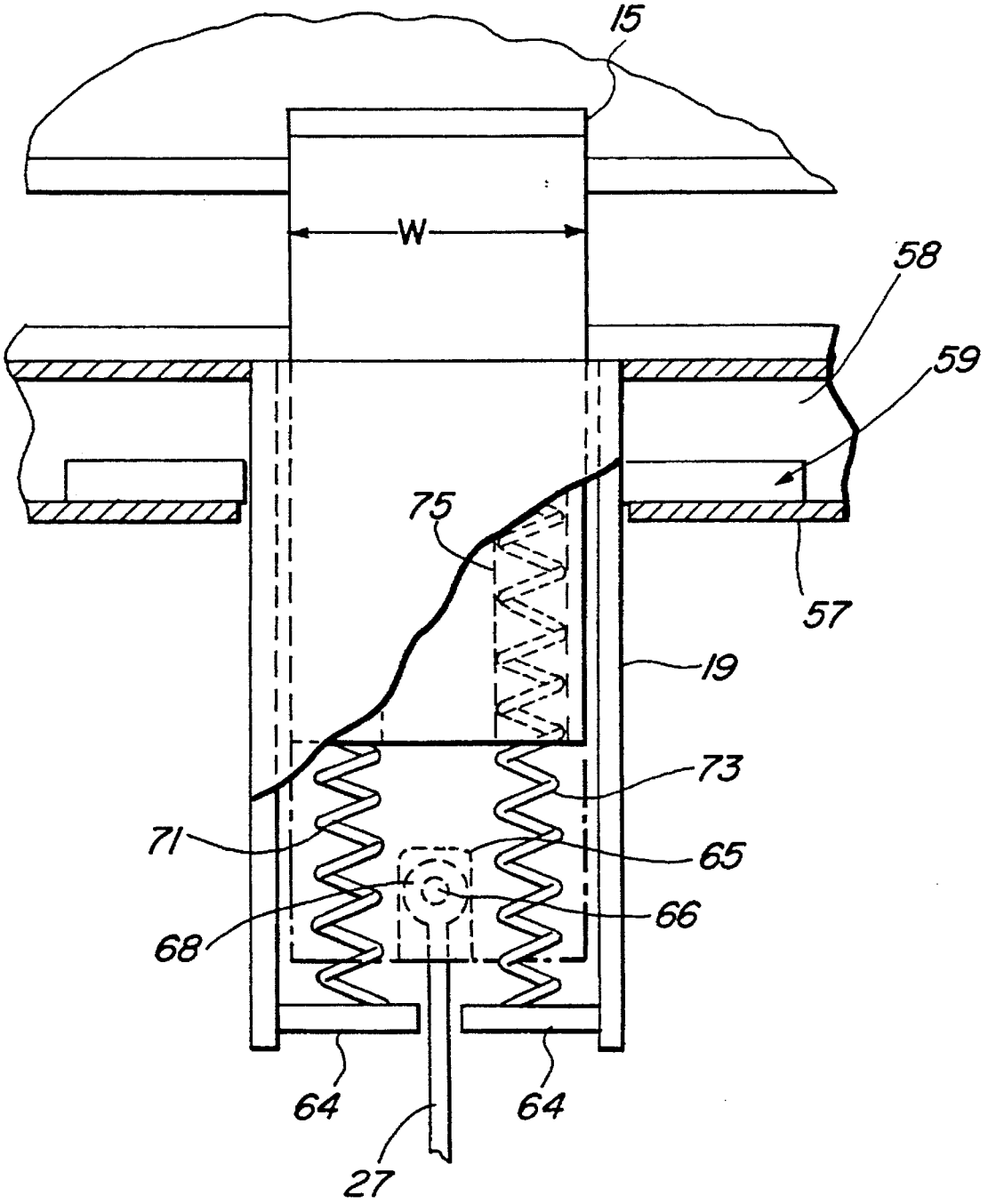
FIG. 3 partially cut-away side view of apparatus shown in FIG. 2.

With reference to FIGS. 1–3, the top load transfer bolts 13, 15 are slidably mounted within respective rectangular housings 17, 19. Each respective bolt 13, 15 is connected to a respective actuating cable 27, 29, which is, in turn, connected to the opposite ends of a cross-member 25. The cross-member 25 is connected at its center to the upper actuation cable 31. As may be seen in FIGS. 2 and 3, each actuation cable 27, 29 is connected to its respective load transfer bolt 15, 13 by means of a pin 66 inserted through an eyelet 68, which is connected to, or formed as part of, the actuation cable, e.g., 27. The eyelet 68 resides within an eyelet receptacle 65 in the load transfer bolt 15.

The housing 19 for the load transfer bolt 15 includes a floor 64 through which the actuating cable 27 passes. First and second springs 71, 73 are connected to the floor 64 and pass into respective cylindrical apertures, e.g. 75, in the generally solid bolt 15. This bolt 15 is preferably steel and is generally rectangular in width and cross-section. The width "W" may be, for example, three inches. The width "W" is thus considerably wider than that of the diameter of the cylindrical dependent bolts, e.g. 22, 24 and, therefore, can support and transfer considerable lateral loads.

As further shown in FIGS. 2 and 3, the upper end of the wall panel 12 includes a generally rectangular channel 57 having a top opening 58 therein through which the load transfer bolt 15 extends and retracts, as further discussed below. The rectangular channel 57 constitutes part of the panel's perimeter structural frame to which a steel panel face is welded. The structural frame also includes similar vertical channel members welded to the steel panel face. Housing 19 (FIG. 3) is attached to the top of the panel structure by means of a plate 59, attached, e.g., by welding to channel 57.

Figure 4:
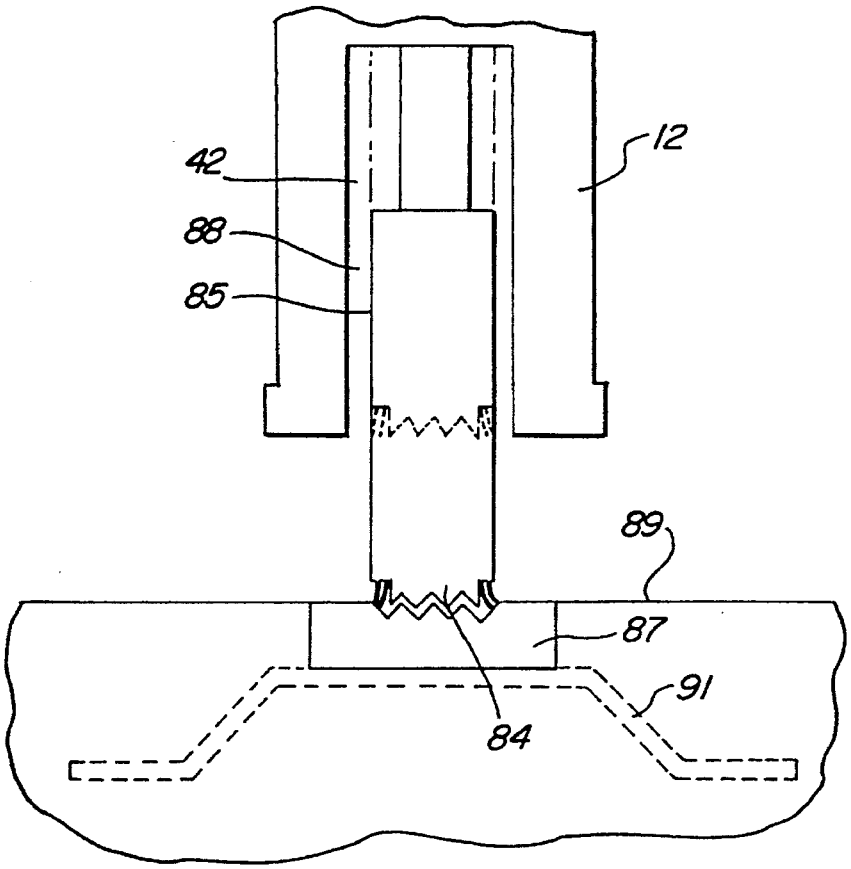
FIG. 4 is a cross-sectional view of load transfer apparatus employed at the bottom of an operable wall panel according to the preferred embodiment.
Figure 5:
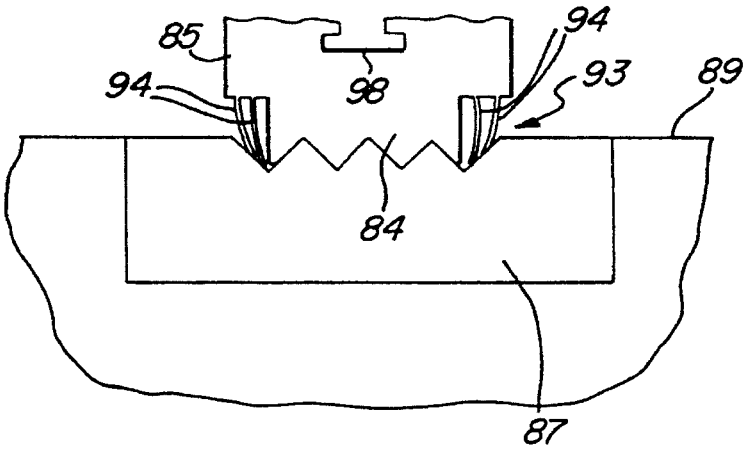
FIG. 5 is an enlarged view of a portion of FIG. 4.

FIGS. 4 and 5 more particularly illustrate the floor engagement apparatus according to the preferred embodiment. This apparatus includes the piston 42, which is mounted to extend and retract in a cavity 88 in the lower end of the wall panel 12. The piston 42 is attached to the lower floor engagement member 85, which has a serrated lower edge 84. The retracted position of edge 84 is shown in phantom in FIG. 4.

The serrated edge 84 engages a floor insert 87. This insert 87 is preferably fabricated of aluminum, brass, bronze, or steel, and has an upper face serrated to mate with the serrated edge 84 of the lower floor engagement member 85. The floor insert 87 may be retained by a concrete anchor 91 (FIG. 4) if the insert 87 is cast into a floor or retained by concrete or grout.

As shown in FIG. 5, the serrated edge 84 is preferably provided by an acoustic gasket member 93. The gasket member 93 is preferably extruded from flexible material such as polyvinylchloride or neoprene, although it could be a metal such as spring steel. Fingers or fins, 94 on either side of the acoustic gasket member 93 provide compliant gaskets which conform to minor surface irregularities and thus provide an effective acoustic seal. The acoustic member 93 may be extruded with a suitable flanged slot 98 to engage and interlock with a mating surface on the bottom edge of lower floor engagement member 85.

As shown in FIG. 1, the actuation lever 35 is connected by means of the lower actuation cable 48 to a connection post 49 attached to the floor engagement member 85. The floor engagement pistons 45, 47 are biased downward by suitable biasing means, such as springs respectively mounted in the housings 41, 43. Thus, pistons 45, 47 normally force the floor engagement member 85 into contact with the continuous floor insert 87. The upper actuation cable 31 is wrapped around a pulley 37 which is fixed within the panel 12, and then connected to the lever 35. Lever 35 is pivotally mounted at a pivot point 39 on the panel 12. Thus, when the lever 35 is moved clockwise in FIG. 1, the cross-member 25 is pulled downward, defeating the spring bias and retracting the top load extension bolts 13, 15. At the same time, the lower actuation cable 48 is pulled upward, retracting the floor engagement member 85 against the spring bias within cylinders 41, 43, thereby disengaging the acoustic gasket 93.

Thus, the preferred embodiment advantageously provides simultaneous disengagement of the load transfer mechanisms. It will be apparent to those skilled in the art that the top and bottom retractable elements 13, 15, 85 can be retracted independently by means of separate levers, cranks, and so forth, should such operation appear desirable. Metal rods or links could be used in place of either cable 31, 48.

It may be noted that the top load transfer bolts 13, 15 must be retracted entirely out of the guide track slot 101 (FIG. 2) in many applications in order to permit movement of the panel 12 when it does not remain centered under its guide track, for example, when traversing curves or angular track intersections, or when the panel is rotating in a horizontal plane.

The design of the surface of track 87 and the mating surface 93 on the bottom of the retractable floor engagement member 85 could take a number of shapes which accomplish load transfer, while not presenting a hazard or impediment to foot traffic or an obstacle to simple cleaning.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. Operable wall apparatus, comprising:

an operable wall panel having top and bottom edges and suspended from a guide track, the bottom edge of said panel being disposed above a floor;

top load transfer means for transferring lateral loads from said wall panel to said guide track, said top load transfer means including means mounted in the top edge of the wall panel and extendable into and removable out of an interfitting relationship with the guide track, the interfitting relationship achieving the transfer of said lateral loads to said guide track; and floor engagement means, mounted in the bottom edge of said panel and the floor beneath said panel and actuatable for engaging the panel with said floor.

2. The apparatus of claim 1, further including:

means for retracting and extending said means mounted in the top edge of the wall panel into and out of said interfitting relationship with said guide track and for actuating said floor engagement means to engage said wall panel with said floor.

3. The apparatus of claim 1 wherein said guide track includes a slot and said top load transfer means includes:

a top load transfer bolt;

housing means in said wall panel for said bolt; and means for spring biasing said bolt in position in said slot in said guide track.

4. The apparatus of claim 2 wherein said floor engagement means comprises:

a continuous floor engagement member;

a floor insert means for mating with said engagement member; and means for spring biasing said engagement member in mating position with said floor insert means.

5. The apparatus of claim 4 wherein said floor engagement member includes an acoustic gasket member having a serrated bottom edge.

6. The apparatus of claim 5, wherein said floor insert means has a serrated edge which conformably mates with that of said acoustic gasket member.

7. The apparatus of claim 4 wherein said means for retracting and extending includes:

cable means connected to a top load transfer bolt and said floor engagement member; and lever means operable to cause said cable means to extend or retract said top load transfer bolt and said floor engagement member.

8. Lateral load transfer apparatus in combination with an operable wall system wherein an operable wall is suspended from a guide track, said operable wall having a lower edge disposed above a floor, said apparatus comprising:

a floor engagement member comprising an acoustic gasket member having a continuous serrated lower edge;

a floor insert means for mating with said engagement member, said floor insert means having a serrated edge which comfortably mates with the serrated edge of said acoustic gasket member; and means, mounted in the lower edge of said operable wall, for applying a bias for biasing said floor engagement member toward said floor, thereby causing engagement between the respective serrated edges of said floor engagement member and said acoustic gasket member and for retracting said floor engagement member against said bias.

9. Operable wall load transfer apparatus in combination with an operable wall panel suspended from a guide track above a floor, comprising:

top load transfer means mounted in a top edge of the wall panel and including at least one rigid member extendable into and out of the guide track for transferring lateral loads from said wall panel to said guide track; and floor engagement means, mounted in the bottom edge of said panel and the floor beneath said panel, for removably engaging the panel with said floor, said floor engagement means comprising:

a continuous floor engagement member including an acoustic gasket member having a serrated bottom edge;

a floor insert means for mating with said engagement member, said floor insert means having a serrated edge which conformably mates with the serrated edge of said acoustic gasket member; and means for spring biasing said engagement member in mating position with said floor insert means.

10. The apparatus of claim 9 further including:

means for retracting and extending said rigid member into and out of said guide track and for extending said floor engagement member into said mating position.

11. The apparatus of claim 9 wherein said rigid member comprises a top load transfer bolt and wherein said top load transfer means further includes:

housing means in said panel wall for said bolt; and means for spring biasing said bolt in position in said guide track.

12. The apparatus of claim 10 wherein said means for retracting and extending includes:

cable means connected to said top load transfer bolt and said floor engagement member; and lever means operable to cause said cable means to extend or retract said top load transfer bolt and said floor engagement member.

13. Operable wall load transfer apparatus in combination with an operable wall panel suspended from a guide track, said wall panel being disposed above a floor, said guide track having a slot therein comprising:

trolley means for suspending said operable wall panel from said guide track and having at least one dependent bolt positioned to ride in said slot;

top load transfer means, mounted in the top edge of the wall panel located adjacent said trolley means and having a rigid member extendable into and entirely out of the slot in said guide track for transferring a lateral load from said wall panel to said guide track; and floor engagement means, mounted in the bottom edge of said wall panel and the floor beneath said panel for engaging the panel with said floor.

14. The apparatus of claim 13, further including:

means for retracting and extending said rigid member into and out of said guide track.

15. The apparatus of claim 14 wherein said rigid member comprises a top load transfer bolt and wherein said top load transfer means includes:

housing means in said wall panel for said bolt; and means for spring biasing said bolt in position in said slot of said guide track.

16. The apparatus of claim 13 wherein said floor engagement means comprises:

a continuous floor engagement member;

a floor insert for mating with said engagement member; and means for spring biasing said engagement member in mating position with said floor insert means.

17. The apparatus of claim 16 wherein said floor engagement member includes an acoustic gasket member having a serrated bottom edge.

18. The apparatus of claim 17, wherein said floor insert means has a serrated edge which conformably mates with the serrated edge of said acoustic gasket member.

19. The apparatus of claim 16 wherein said means for retracting and extending includes:

cable means connected to said top load transfer means and said floor engagement member; and lever means operable to cause said cable means to extend or retract said top load transfer means and said floor engagement member.

20. Operable wall apparatus, comprising:

an operable wall panel suspended from a guide track above a floor located beneath said guide track; and top load transfer means for transferring lateral loads from said wall panel to said guide track, said top load transfer means including means mounted in the top edge of the wall panel and extendable into and removable out of an interfitting relationship with the guide track, said interfitting relationship achieving said lateral load transfer.

21. The apparatus of claim 20 further including:

means for retracting and extending said means mounted in the top edge of said wall panel into and out of said interfitting relationship with said guide track.

22. The apparatus of claim 20 wherein said guide track includes a slot and said means located in the top edge of said panel includes a top load transfer bolt.

23. The apparatus of claim 22 further including:

means for spring biasing said top load transfer bolt in position in said slot in said guide track.

24. The apparatus of claim 21 wherein said guide track includes a slot and said means located in the top edge of said panel includes:

a top load transfer bolt; and means for spring biasing said top load transfer bolt in position in said slot in said guide track.

25. The apparatus of claim 22 wherein said top load transfer means further includes: housing means in said wall for said bolt; and means for spring biasing said bolt in position in said guide track.

26. The apparatus of claim 24 wherein said means for retracting and extending includes:

cable means connected to said top load transfer bolt; and lever means operable to cause said cable means to extend or retract said top load transfer bolt.

27. The apparatus of claim 20 wherein said guide track includes a slot and said means located in the top edge of said panel includes a rigid member extendable into and removable out of an interfitting relationship with said slot.

28. Operable wall apparatus, comprising:

an operable wall panel suspended from a guide track above a floor located beneath said guide track; and top load transfer means for transferring a lateral load from said wall panel to said guide track, said top load transfer means including a rigid member and means for mounting said rigid member such that said rigid member is extendable into and removable out of an interfitting relationship with the guide track, said rigid member, when positioned in said interfitting relationship, causing transfer of said lateral load from said rigid member to said guide track.

29. Operable wall apparatus comprising:

an operable wall panel suspended from a guide track above a floor; first and second top load transfer bolts;

first and second housing means located in said wall panel for respectively housing said top load transfer bolts; and means for supplying a bias to said first and second top load transfer bolts biasing said bolts in position in the slot of said guide track of said operable wall such that lateral loads are transferred from said bolts to said guide track, and for retracting said first and second bolts entirely out of said guide track against said bias.

* * * * *